US006158992A

United States Patent [19]

Morita

[11] Patent Number: 6,158,992

[45] **Date of Patent: *Dec. 12, 2000**

[54] ROTARY PUMP HAVING A SUBSTANTIALLY TRIANGULAR ROTOR

[75] Inventor: Shoji Morita, Kanagawa, Japan

[73] Assignee: Unisia Jecs Corporation, Atsugi, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/827,106

[22] Filed: Sep. 13, 2000

[30] Foreign Application Priority Data

Mar. 21, 1996 [JP] Japan ..... 8-064034
Mar. 28, 1996 [JP] Japan ..... 8-073025

[51] Int. Cl.[7] ..... F04C 2/22
[52] U.S. Cl. ..... 418/61.2
[58] Field of Search ..... 418/61.2, 15

[56] References Cited

U.S. PATENT DOCUMENTS

| | | | |
|---|---|---|---|
| 2,342,088 | 2/1944 | Rappl | 418/160 |
| 3,260,247 | 7/1966 | Gassmann et al. | 418/61.2 |
| 3,671,153 | 6/1972 | Luck | 418/61.2 |
| 3,966,370 | 6/1976 | Huf | 418/183 |
| 4,278,409 | 7/1981 | Eiermann | 418/61.2 |
| 4,410,299 | 10/1983 | Shimoyama | 418/61.2 |
| 4,551,073 | 11/1985 | Schwab | 418/61.2 |

FOREIGN PATENT DOCUMENTS

| | | | |
|---|---|---|---|
| 2 260 008 | 8/1975 | France . | |
| 1905321 | 8/1970 | Germany | 418/61.2 |
| 2021 513 | 11/1971 | Germany . | |
| 4204186 | 8/1993 | Germany | 418/61.2 |
| 58-77191 | 5/1983 | Japan | 418/61.2 |
| 60-192893 | 10/1985 | Japan | 418/61.2 |
| 64-15726 | 1/1989 | Japan . | |
| 958705 | 9/1982 | U.S.S.R. | 418/61.2 |
| 583035 | 12/1946 | United Kingdom | 418/61.2 |

*Primary Examiner*—John J. Vrablik
*Attorney, Agent, or Firm*—Foley & Lardner

[57] ABSTRACT

A rotary pump includes a substantially triangular rotor rotatably arranged in a housing and including vertexes which are in slide contact with a trochoid curved surface of the inner periphery of the housing. The housing and the rotor cooperate with each other to define a pair of suction working chambers and a pair of discharge working chambers. The housing is formed with a pair of suction ports to communicate with the pair of suction working chambers when the pump proceeds to the suction stroke, and with a pair of discharge ports to communicate with the pair of discharge working chambers when the pump proceeds to the compression stroke.

13 Claims, 18 Drawing Sheets

ROTARY PUMP HAVING A SUBSTANTIALLY TRIANGULAR ROTOR

BACKGROUND OF THE INVENTION

The present invention relates to a rotary pump that serves for example as an oil pump for motor vehicles.

Various types of oil pump such as an internal gear pump and a plunger pump have been proposed to supply lubricating oil to an internal combustion engine, and working oil to a power steering for motor vehicles.

As for internal combustion engines for motor vehicles, a Wankel-type rotary engine is known, in addition to a reciprocating engine, which continuously carries out four strokes of suction, compression, expansion, and exhaust per rotation of a rotor contacting a trochoid curved surface (see JP-U 64-15726).

An outline of the Wankel-type rotary engine will be described. Side housings are arranged to both side faces of a rotary housing having a peritrochoid curved surface on the inner periphery thereof. A substantially triangular rotor is accommodated in the rotary housing to be rotatable while contacting the peritrochoid curved surface. Three working chambers are defined by the outer periphery of the rotor and the peritrochoid curved surface of the rotary housing. An output shaft or a crankshaft arranged through the side housings has a predetermined outer peripheral portion with which a disk-like eccentric portion is integrally formed having the center eccentric to the axis of the output shaft. The inner periphery of the rotor is supported on the outer periphery of the eccentric portion. A small-diameter stationary gear is fixed on the inner periphery of an output-shaft through hole of one of the side housings to face the working chambers. A rotor gear is formed to the inner periphery of the rotor on one end side thereof to engage with the stationary gear.

The rotary housing has parallel suction and exhaust ports formed at one side thereof, and a pair of ignition plugs mounted at another side thereof.

Rotation of the rotor after engine start causes rotation of the eccentric portion and the output shaft, and that of the rotor gear and the stationary gear engaged with each other, so that a vertex of the rotor makes rotation in tracing a peritrochoid curve or a fundamental curve of the rotary housing, transmitting power to the output shaft. That is, rotation of the rotor opens the suction port to start the suction stroke, which gradually increase the volume of the two working chambers. When this volume reaches the maximum value, the suction port is automatically closed. Then, fuel-air mixture within the working chambers is compressed, and ignited in the vicinity of the top dead center of the compression stroke, proceeding to the expansion stroke. After the expansion stroke, the exhaust port is opened to complete the exhaust stroke, proceeding again to the suction stroke. This process produces three rotations of the output shaft per rotation of the rotor, transmitting power to the output shaft.

Recently, due to its extremely high power efficiency, an attempt is made to apply the fundamental structure of such four-stroke one-cycle rotary engine to the oil pump for motor vehicles, etc. However, since the rotary engine, which is concerned in compressible fluid such as fuel-air mixture, serves as an engine in accordance with the compression and expansion strokes of compressible fluid, i.e., a volume change of the working chambers, the rotary engine cannot serve as an oil pump that for non-compressible fluid such as oil. That is, the non-compressible nature of fluid in accordance with a great volume change of the working chambers, makes it impossible for the rotary engine to serve as an oil pump.

It is, therefore, an object of the present invention to provide a rotary pump which is constructed with the fundamental structure of the rotary engine.

SUMMARY OF THE INVENTION

According to one aspect of the present invention, there is provided a pump which is operative in suction and compression strokes, comprising:

- a housing with an inner periphery, said inner periphery including a trochoid curved surface;
- a rotor rotatably arranged in said housing, said rotor having a substantially triangular shape, said rotor including vertexes which are in slide contact with said trochoid curved surface of said housing,
- said housing and said rotor cooperating with each other to define a pair of suction working chambers and a pair of discharge working chambers;
- means for defining a pair of suction ports, said pair of suction ports communicating with said pair of suction working chambers when the pump proceeds to the suction stroke; and
- means for defining a pair of discharge ports, said pair of discharge ports communicating with said pair of discharge working chambers when the pump proceeds to the compression stroke.

Another aspect of the present invention lies in providing a pump which is operative in suction and compression strokes, comprising:

- a housing with an inner periphery, said inner periphery including a trochoid curved surface;
- a rotor rotatably arranged in said housing, said rotor having a substantially triangular shape, said rotor including vertexes which are in slide contact with said trochoid curved surface of said housing,
- said housing and said rotor cooperating with each other to define a pair of suction working chambers and a pair of discharge working chambers;
- means for defining a pair of suction ports, said pair of suction ports communicating with said pair of suction working chambers when the pump proceeds to the suction stroke;
- means for defining a pair of discharge ports, said pair of discharge ports communicating with said pair of discharge working chambers when the pump proceeds to the compression stroke;
- means for defining a communication passage for fluid communication of said pair of discharge ports on the downstream side thereof; and
- means for defining a confluent passage, said confluent passage being connected to said communication passage on the downstream side thereof.

DETAILED DESCRIPTION OF THE INVENTION

Figure 1:
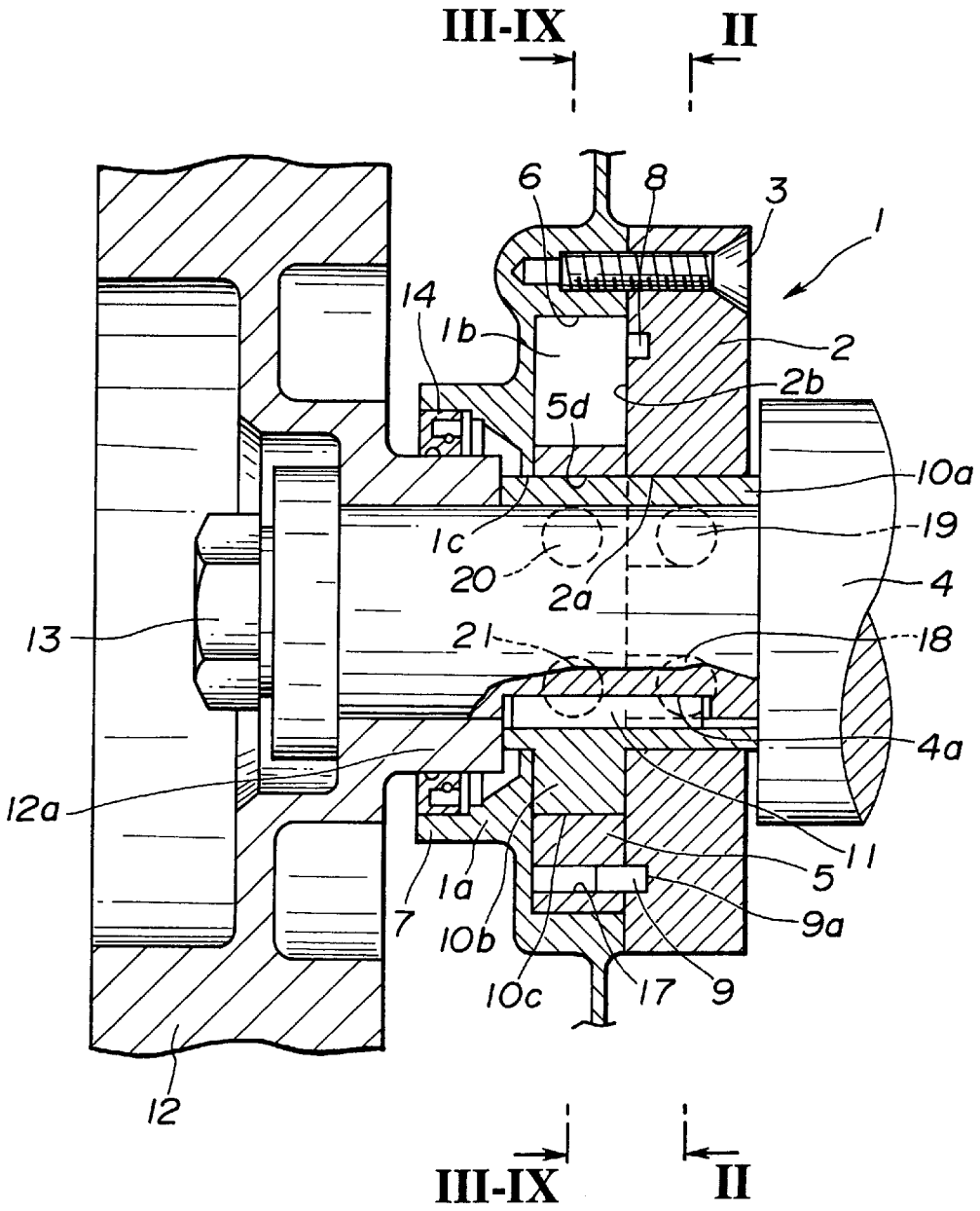
FIG. 1 is a longitudinal section showing a first preferred embodiment of a rotary pump according to the present invention.

Referring to the drawings, preferred embodiment of a rotary pump will be described.

Figure 2:
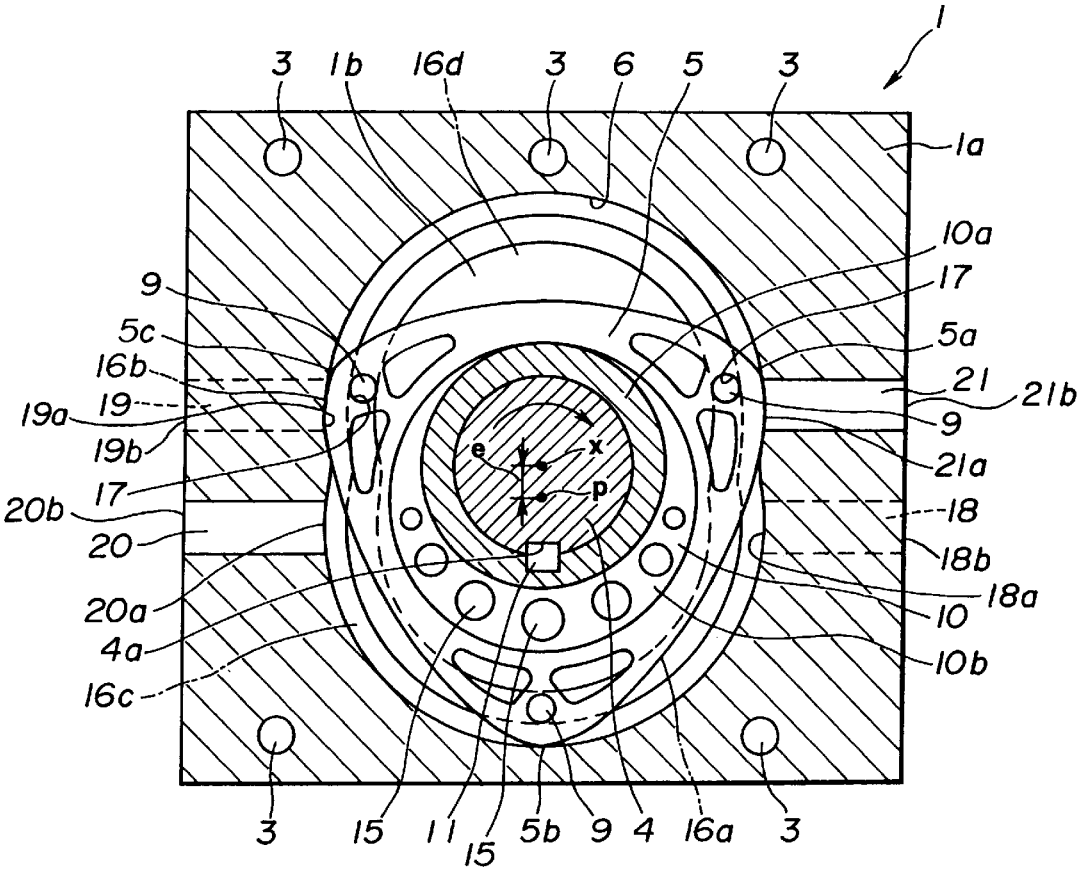
FIG. 2 is a cross section taken along the line II—II in FIG. 1.

FIGS. 1–9 show a first embodiment of the present invention. Referring to FIGS. 1–2, a housing 1 comprises a housing main body 1*a* fixed to a cylinder block, of an internal combustion engine, and a cover 2 fixed to the housing main body 1*a* at one end thereof by a flush bolt 3 so as to close an opening thereat. A drive shaft 4 is arranged through a through hole formed in the center of the housing main body 1*a* and the cover 2. The cover 2 and a concavity 1*b* formed in the housing main body 1*a* define a space in which a substantially triangular rotor 5 is rotatably arranged.

The housing main body 1*a* is constructed such that the inner periphery of the concavity 1*b* is formed like a cocoon, i.e., a trochoid curved surface 6, and a cylindrical protrusion 7 is integrally formed with the side opposite to the cover 2 on the inner-periphery side thereof. Like the housing main body 1*a*, the cover 2 has a rectangular external form, and is positioned to the housing main body 1*a* by a positioning pin, not shown.

The drive shaft 4 is directly connected to a crankshaft of the internal combustion engine. The drive shaft 4 has the outer periphery on which an eccentric collar 10 is fixed by a key 11 arranged in an outer-periphery groove 4*a* formed longitudinally, and an end to which a drive pulley 12 is fixed by a bolt 13 axially engaged therewith. The drive pulley 12 has on the inner-periphery side of the main body thereof a cylindrical portion 12*a* engaged with the outer periphery of the drive shaft 4, and serves to transmit torque to the drive shaft 4 through a timing belt, not shown. A sealing member 14 is interposed between the protrusion 7 of the housing 1 and the cylindrical portion 12*a* of the drive pulley 12.

The eccentric collar 10 comprises a cylindrical portion 10*a* engaged with the outer periphery of the drive shaft 4, and an eccentric plate 10*b* integrally formed with the cylindrical portion 10*a* on the drive-pulley side outer periphery thereof. The eccentric collar 10 has a center P which is radially eccentric to an axis X of the drive shaft 4 by e. The cylindrical portion 10*a* has front and rear ends extending up to a through hole 1*c* of the housing 1 and a through hole 2*a* of the cover 2. For axial positioning, the front end abutting on an edge of the cylindrical portion 12*a* of the drive pulley 12, and the rear end abutting on a stepped end face of the drive shaft 4. The eccentric plate 10*b* is circumferentially formed with holes 15 of different sizes for weight reduction and balance.

The rotor 5 has the thickness or width which is slightly smaller than the width of the concavity 1*b* of the housing 1, and has the outer surface between vertexes 5*a*–5*c*, which surface cooperates with the trochoid curved surface 6 of the housing main body 1*a* to define four working chambers 16*a*–16*d*. The rotor 5 makes rotation with the vertexes 5*a*–5*c* always contacting the trochoid curved surface 6 to trace a peritrochoid curve. As shown in FIG. 1, a circular hole is formed in the center of the rotor 5, and has an inner periphery 5*d* engaged with an outer periphery 10*c* of the eccentric plate 10*b* of the eccentric collar 10.

Referring to FIGS. 2–8, the four working chambers, which are defined in accordance with the rotational positions of the rotor 5, include a first suction working chamber 16*a*, a second suction working chamber 16*b* simultaneously defined on the opposite side thereof, a first discharge working chamber 16*c*, and a second discharge working chamber 16*d* defined on the opposite side thereof, the discharge working chambers being converted from the suction working chambers after their maximum volume change.

A guide means is arranged between the cover 2 and the rotor 5 to rotatably guide the rotor 5 along the trochoid curved surface 6. Specifically, the guide means comprises an endless guide groove 8 formed on an inner side-surface 2*b* of the cover 2, and three guide pins 9 arranged to a side surface of the rotor 5 on the side of the inner side-surface 2*b* and engaged with the guide groove 8.

As shown in FIGS. 1–2, the guide groove 8 is formed on the inner side-surface 2*b* to have a C-shaped cross section, and is shaped like a cocoon along the trochoid curved surface 6. On the other hand, each guide pin 9 has a base press fit in a fixing hole 17 arranged through the rotor 5 in the vicinity of each vertex 5*a*–5*c* to correspond to the guide groove 8, and a pointed end 9*a* engaged with the guide groove 8 with a slight clearance.

Referring to FIGS. 1–8, the cover 2 has a pair of suction ports 18, 19 formed therein. The suction ports 18, 19 are oppositely formed substantially horizontally with respect to both side portions of the cover 2, and with slight vertical offset with respect thereto. The first suction port 18 has an end 18*a* which can communicate with the first suction working chamber 16*a* defined with rotation of the rotor 5, whereas the second suction port 19 has an end 19*a* which can communicate with the second suction working chamber 16*b*. Inlets 18*b*, 19*b* of the suction ports 18, 19 communicate with an oil pan through a confluent passage, not shown, into which two passages connected to the inlets 18*b*, 19*b* merge upstream.

Referring to FIGS. 1–8, the housing main body 1*a* has a pair of discharge ports 20, 21 formed therein. The discharge ports 20, 21 are oppositely formed substantially horizontally with respect to both side portions of the housing main body 1*a* and in parallel to the suction ports 18, 19, and with slight vertical offset with respect thereto. The first discharge port 20 arranged above the first suction port 18 has an end 20*a* which can communicate with the first discharge working chamber 16*c* defined with rotation of the rotor 5, whereas the second discharge port 21 arranged below the second suction port 19 has an end 21*a* which can communicate with the second discharge working chamber 16*d*. Outlets 20*b*, 21*b* of the discharge ports 20, 21 communicate with slide portions such as an engine valve actuator and a piston disposed near the outlets 20*b*, 21*b* through a passage, not shown.

Thus, according to the first embodiment, when the drive shaft 4 is rotated through the drive pulley 12, the eccentric collar 10 is also rotated synchronistically to transmit torque through the outer periphery to the rotor 5. Referring to FIGS. 2–9, this makes rotation of the rotor 5 along the trochoid curved surface 6 with the guide pins 9 being slidingly moved and smoothly guided in the guide groove 8.

Figure 3:
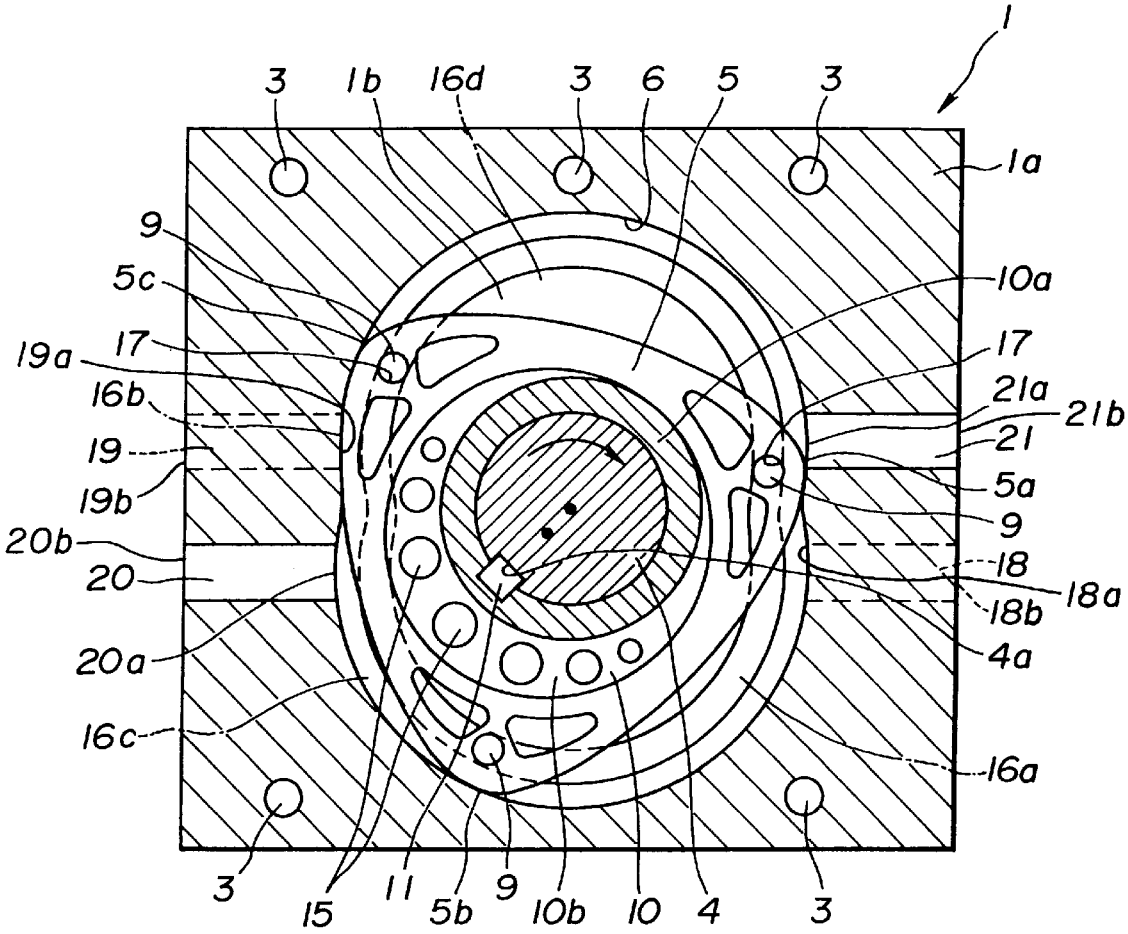
FIG. 3 is a view similar to FIG. 2, taken along the line III—III in FIG. 1.

A consideration will be made with regard to the operation of the pump in the rotational positions of the rotor 5 as shown in FIGS. 2–9. In the positions as shown in FIGS. 2–3, when the vertex 5*a* opens the end 21*a* of the second discharge port 21, the first suction working chamber 16*a* communicates with the first suction port 18 to suck lubricating oil in the first suction working chamber 16*a* (suction stroke).

Figure 4:
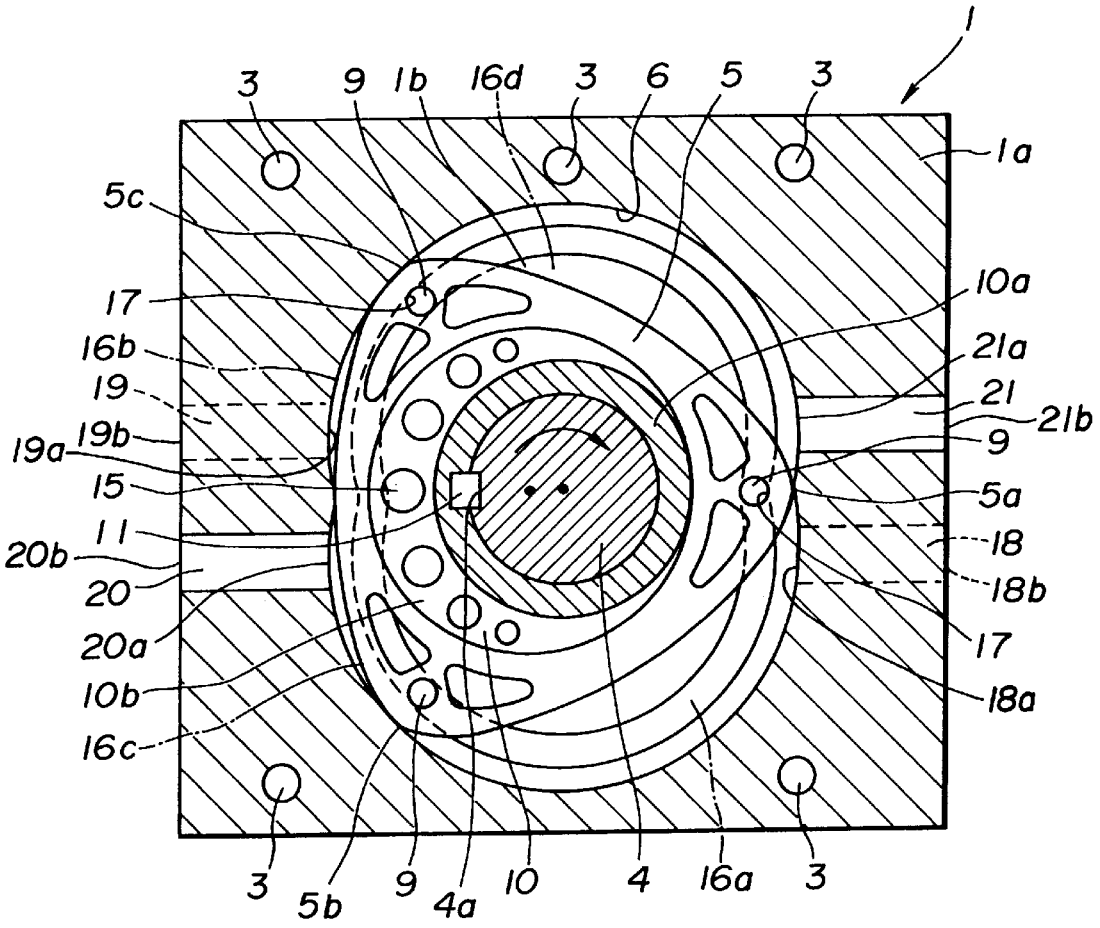
FIG. 4 is a view similar to FIG. 3, taken along the line IV—IV in FIG. 1.
Figure 5:
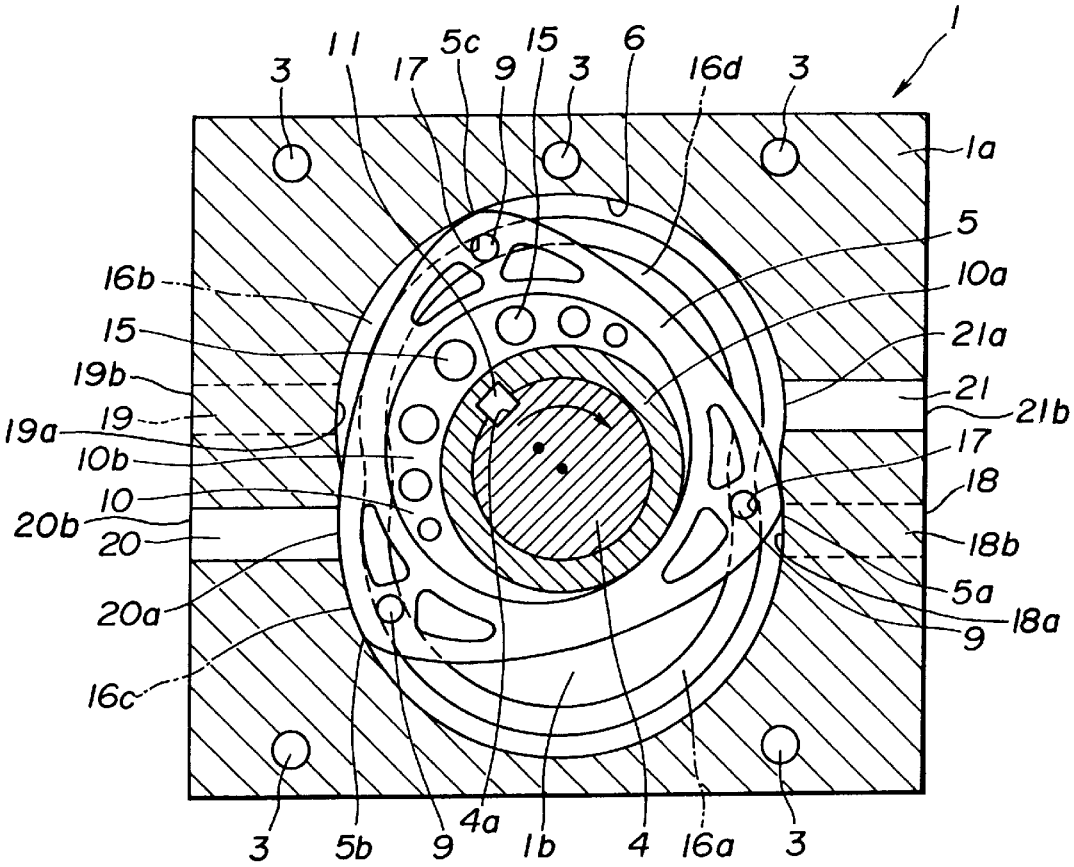
FIG. 5 is a view similar to FIG. 4, taken along the line V—V in FIG. 1.
Figure 6:
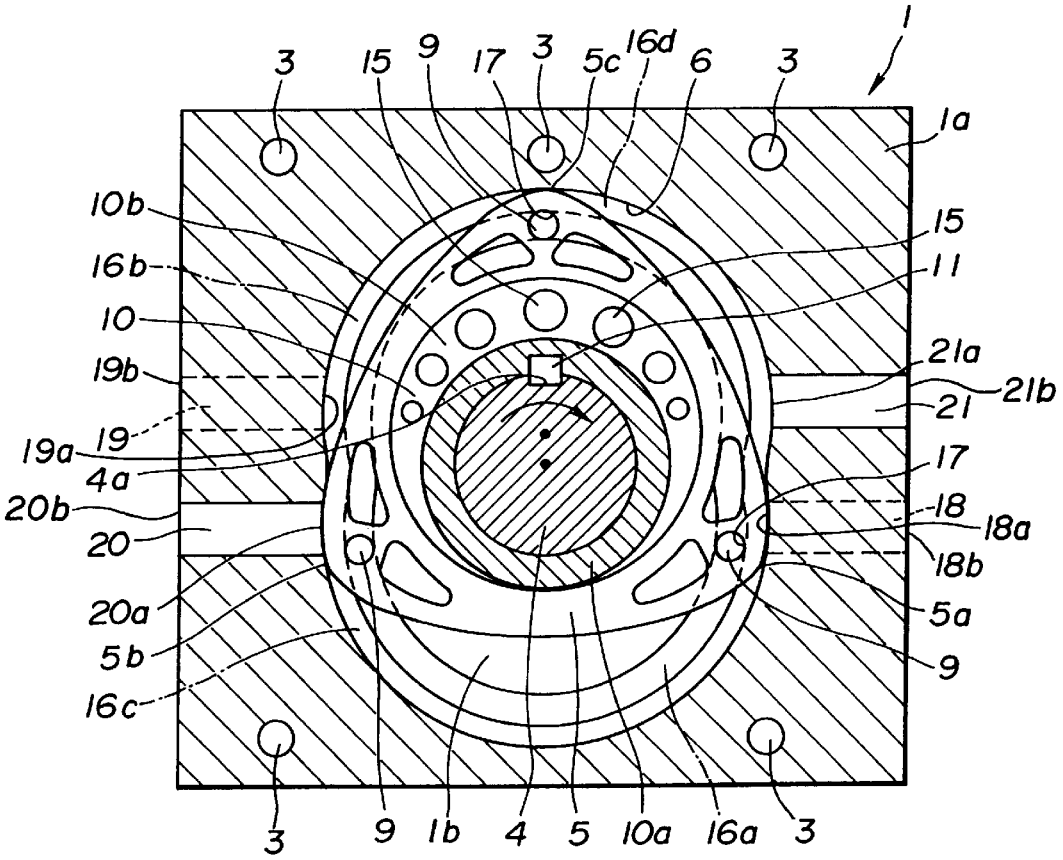
FIG. 6 is a view similar to FIG. 5, taken along the line VI—VI in FIG. 1.

With further rotation of the rotor 5, the volume of the first suction working chamber 16*a* is increased as shown in FIGS. 4–5. When this volume reaches the maximum value (expansion stroke) as shown in FIG. 6, the first suction working chamber 16*a* is filled with lubricating oil, proceeding to the compression stroke.

Figure 7:
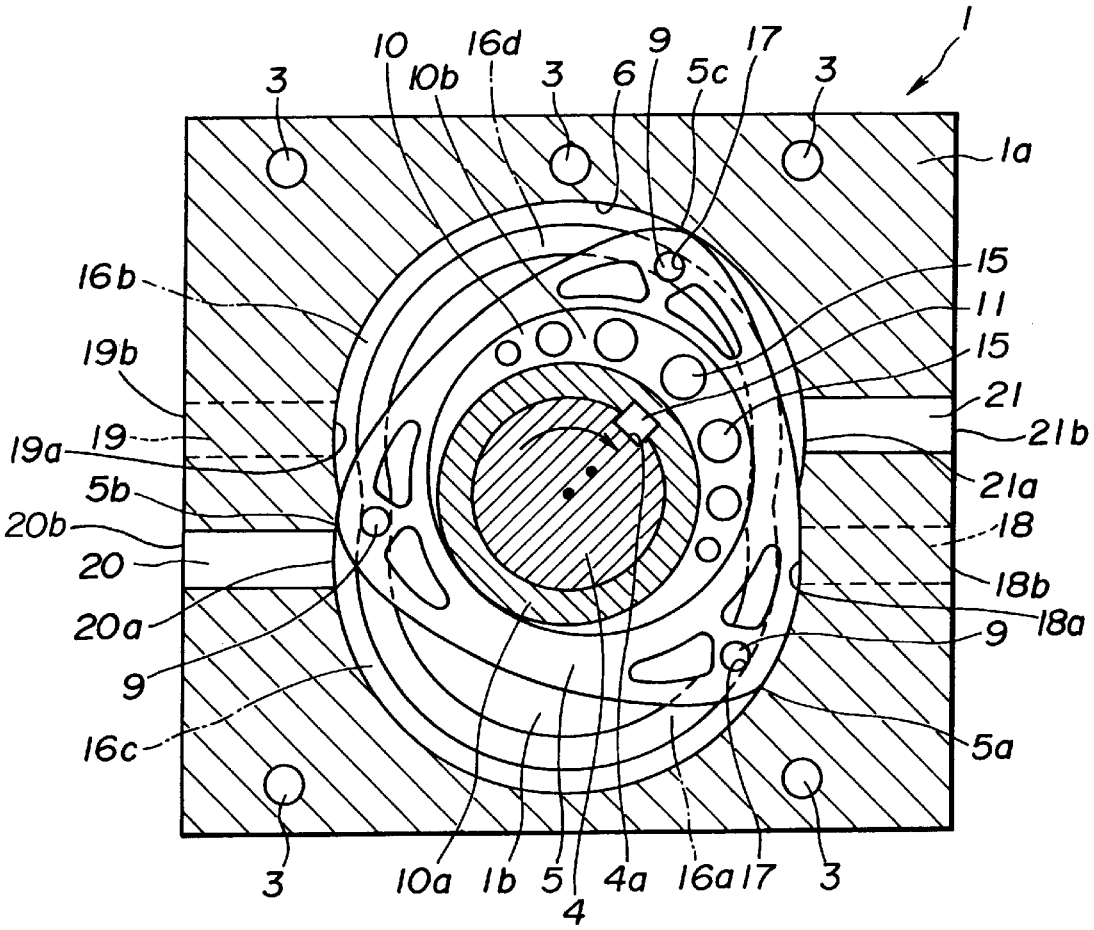
FIG. 7 is a view similar to FIG. 6, taken along the line VII—VII in FIG. 1.
Figure 8:
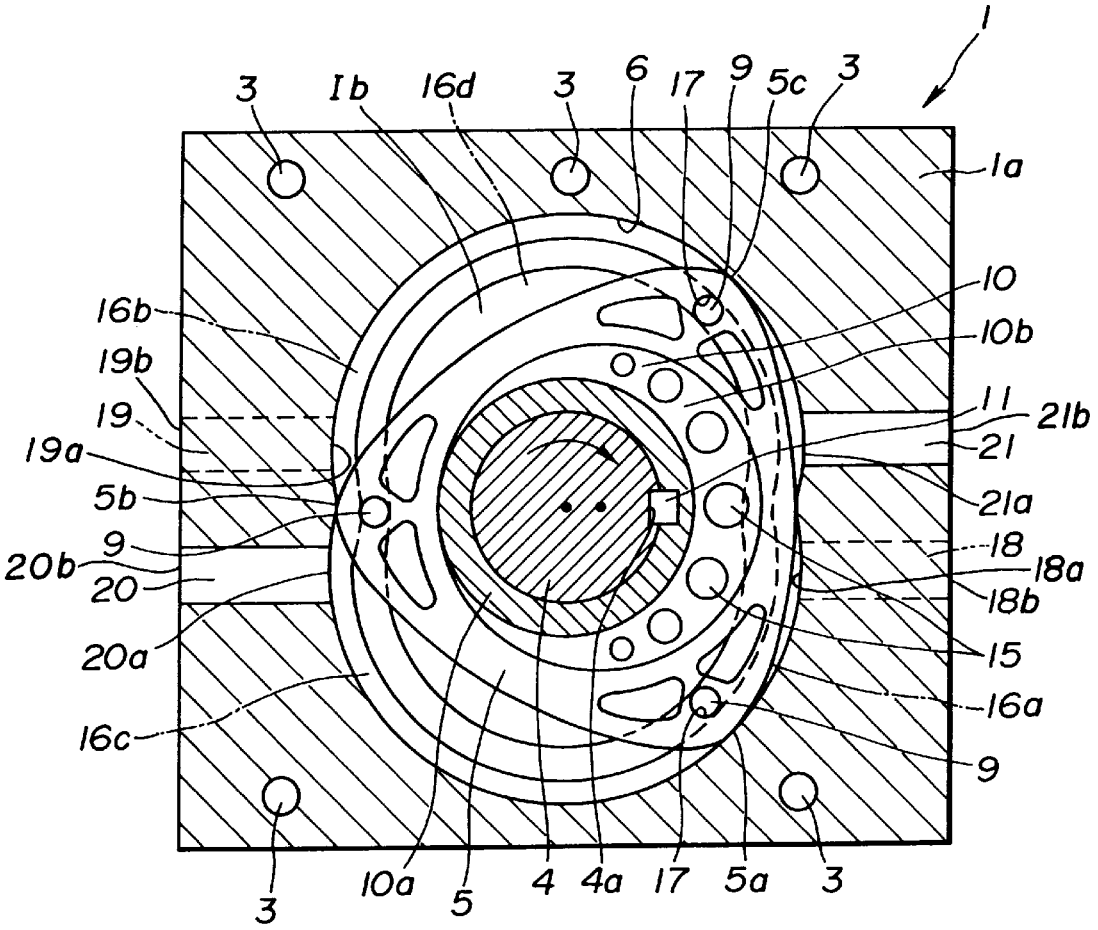
FIG. 8 is a view similar to FIG. 7, taken along the line VIII—VIII in FIG. 1.
Figure 9:
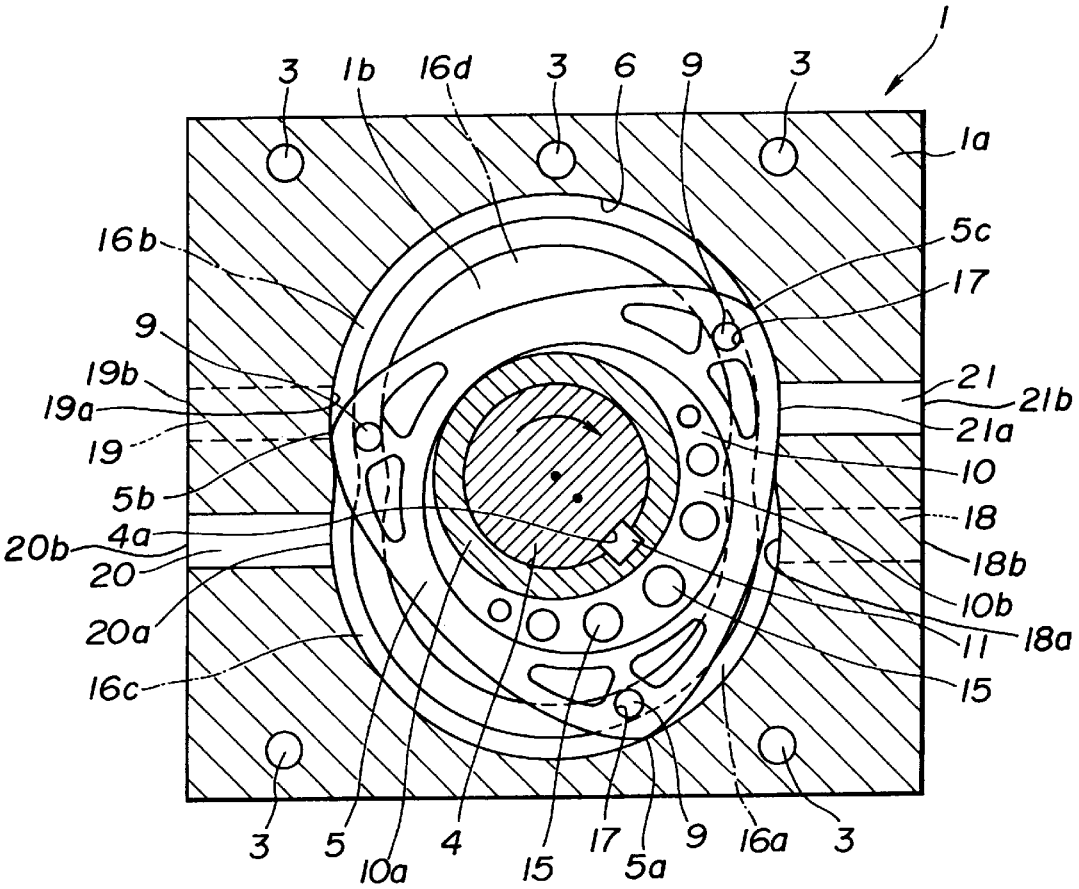
FIG. 9 is a view similar to FIG. 8, taken along the line IX—IX in FIG. 1.

Subsequently, as shown in FIGS. 7–8, as soon as the compression stroke starts, i.e., a volume reduction of the first suction working chamber 16*a* starts, the first suction working chamber 16*a* is converted to the first discharge working chamber 16*c*, and the vertex Sb opens the first discharge port 20 which thus communicates with the first discharge working chamber 16*c*. As a result, lubricating oil within the first discharge working chamber 16*c* is fed by torque of the rotor 5 to the above slide portions through the first discharge port 20 (discharge stroke).

With further rotation of the rotor 5, the above suction, expansion, compression, and discharge strokes are repeatedly carried out as shown in FIGS. 2–9, ensuring the pump operation.

On the other hand, with rotation of the rotor 5, the second suction working chamber 16*b* starts a suction from the second suction port 19 in the position as shown in FIG. 8, and gradually increases the volume to reach the maximum. As shown in FIGS. 2–9, as soon as the vertex 5*c* closes the second suction port 19, the second suction working chamber 16*b* is converted to the second discharge working chamber 16*d*, proceeding to the compression stroke. Moreover, as shown in FIG. 3, the second discharge working chamber 16*d* communicates with the second discharge port 21 to discharge lubricating oil, ensuring the pump operation in accordance with the same volume change as that of the first suction and discharge working chambers 16*a*, 16*c*.

In brief, when passing from the suction stroke to the compression stroke, the pump immediately proceeds to the discharge stroke to discharge lubricating oil within the discharge working chambers 16*c*, 16*d* to the discharge ports 20, 21 without carrying out strong compression of lubricating oil or non-compressible fluid, enabling the continuous pump operation.

In such a way, the first embodiment makes slight modifications in the fundamental structure of the rotary engine to materialize a rotary pump, enabling increased discharge amount per rotation of the rotor 5 due to increased volume of the working chambers 16*a*–16*d*, resulting in an improvement of the pump efficiency. That is, the rotary pump has greater maximum volume of the working chambers 16*a*–16*d* than that of the other oil pump such as an internal gear pump, having increased discharge amount per rotation of the rotor 5. This enables a rotary pump with fully-reduced overall size when having the same capacity as that of the conventional oil pump, contributing to a reduction in pump size and weight.

Further, pairs of suction working chambers 16*a*, 16*b*, suction working chambers 16*c*, 16*d*, suction ports 18, 19, and discharge ports 20, 21 enable simultaneous double pump operation, obtaining a further improvement of the pump efficiency, resulting in a further reduction in pump size and weight.

Furthermore, since the discharge ports 20, 21 are oppositely formed in the side portions of the housing main body 1*a*, lubricating oil can be supplied to the slide portions disposed in different engine positions and near the discharge ports 20, 21.

Still further, in the first embodiment, the guide means includes the guide groove 8 and the guide pin 9 in place of a gear, obtaining largely simplified structure and reduced number of parts, resulting in an improvement of the manufacturing efficiency and a cost reduction. The simplified structure exempts requirements of the high machining accuracy of the guide groove 8, etc., contributing to an improvement of the machining efficiency.

Further, due to the fact that the guide groove 8 is formed in the cover 2 by notching, and the guide pin 9 is simply fixed to the rotor 5, a space for mounting the gear is not needed, resulting in a reduction in pump size and weight.

Figure 10:
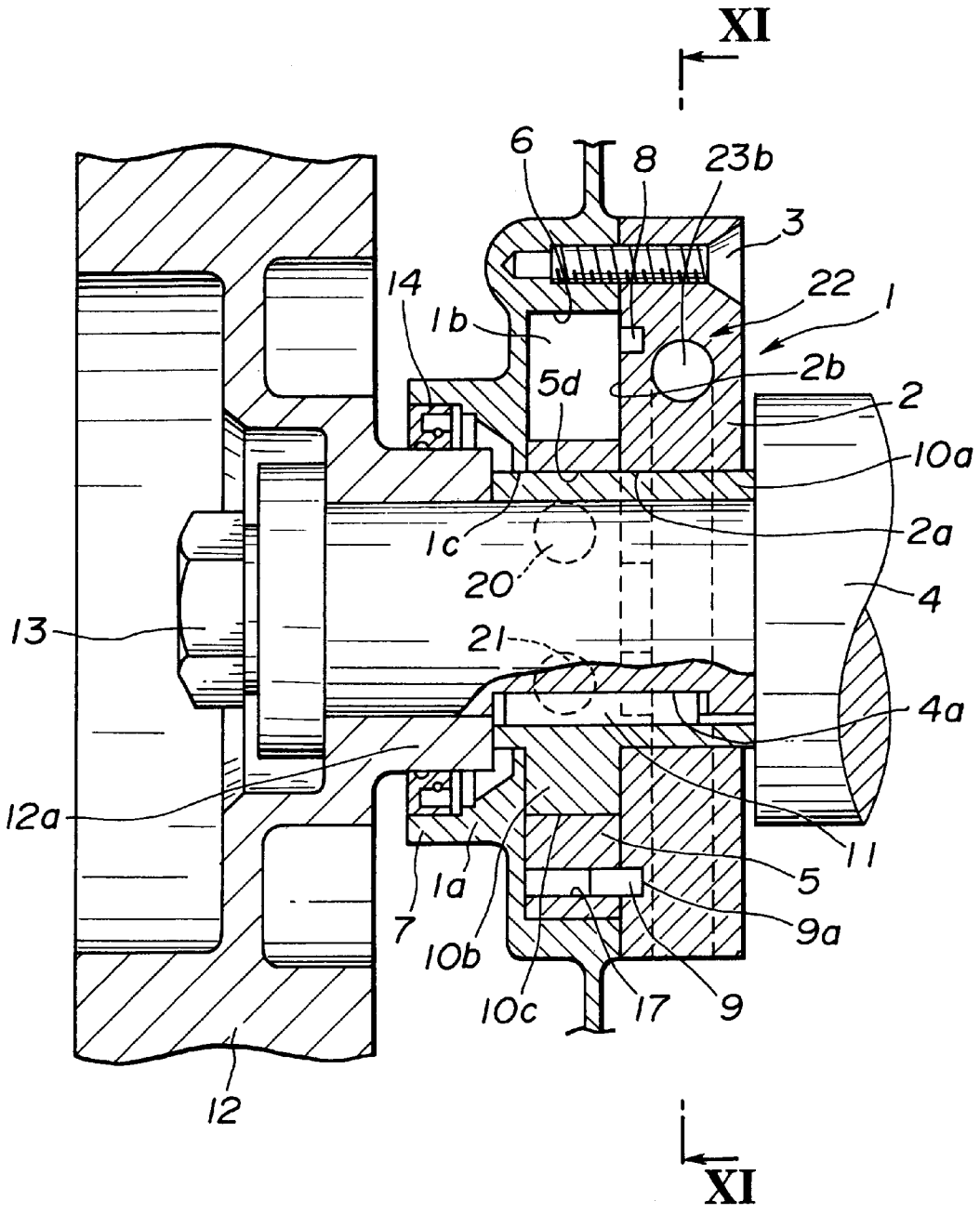
FIG. 10 is a view similar to FIG. 1, showing a second preferred embodiment of the present invention.
Figure 11:
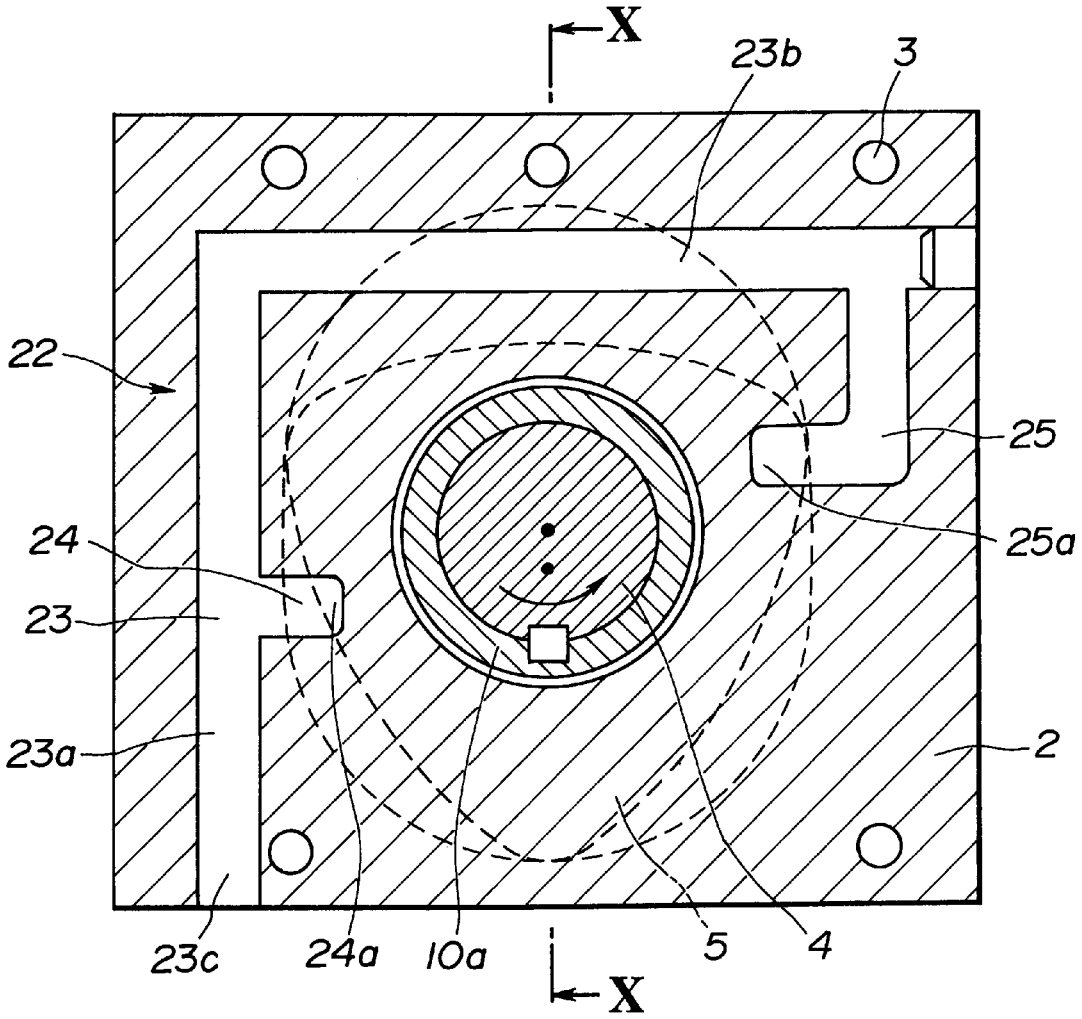
FIG. 11 is a view similar to FIG. 9, taken along the line XI—XI in FIG. 10.

FIGS. 10–11 show a second embodiment of the present invention wherein the suction passageway 22 is branched in the cover 2. Specifically, the suction passageway 22 comprises a substantially L-shaped main port 23, and two suction branch ports 24, 25 branched from predetermined positions of the main port 23. The main port 23 includes an upstream portion 23*a* vertically formed in one side portion of the cover 2, and a downstream portion 23*b* extending horizontally from the upper end of the upstream portion 23*a*, the upstream portion 23*a* having an upstream end 23*c* which communicates with the oil pan through a suction passage, not shown. The first suction branch port 24 extends horizontally from substantially the center of the upstream portion 23*a*, and has an end 24*a* communicating with the first suction working chamber 16*a*. The second suction branch port 25 extends downward from a downstream end of the downstream portion 23*b* to form substantially an L-shape, and has an end 25*a* which communicates with the second suction working chamber 16*b*.

Thus, the second embodiment not only produces the same effect as that of the first embodiment, but achieves, with the suction passageway 22 formed to include in the cover 2 the main port 23 and the branch ports 24, 25 branched therefrom, the simpler passage structure than that of the first embodiment wherein the suction ports communicates with each other through a passage outside the cover 2, resulting in an improvement of the manufacturing efficiency and a cost reduction.

Figure 12:
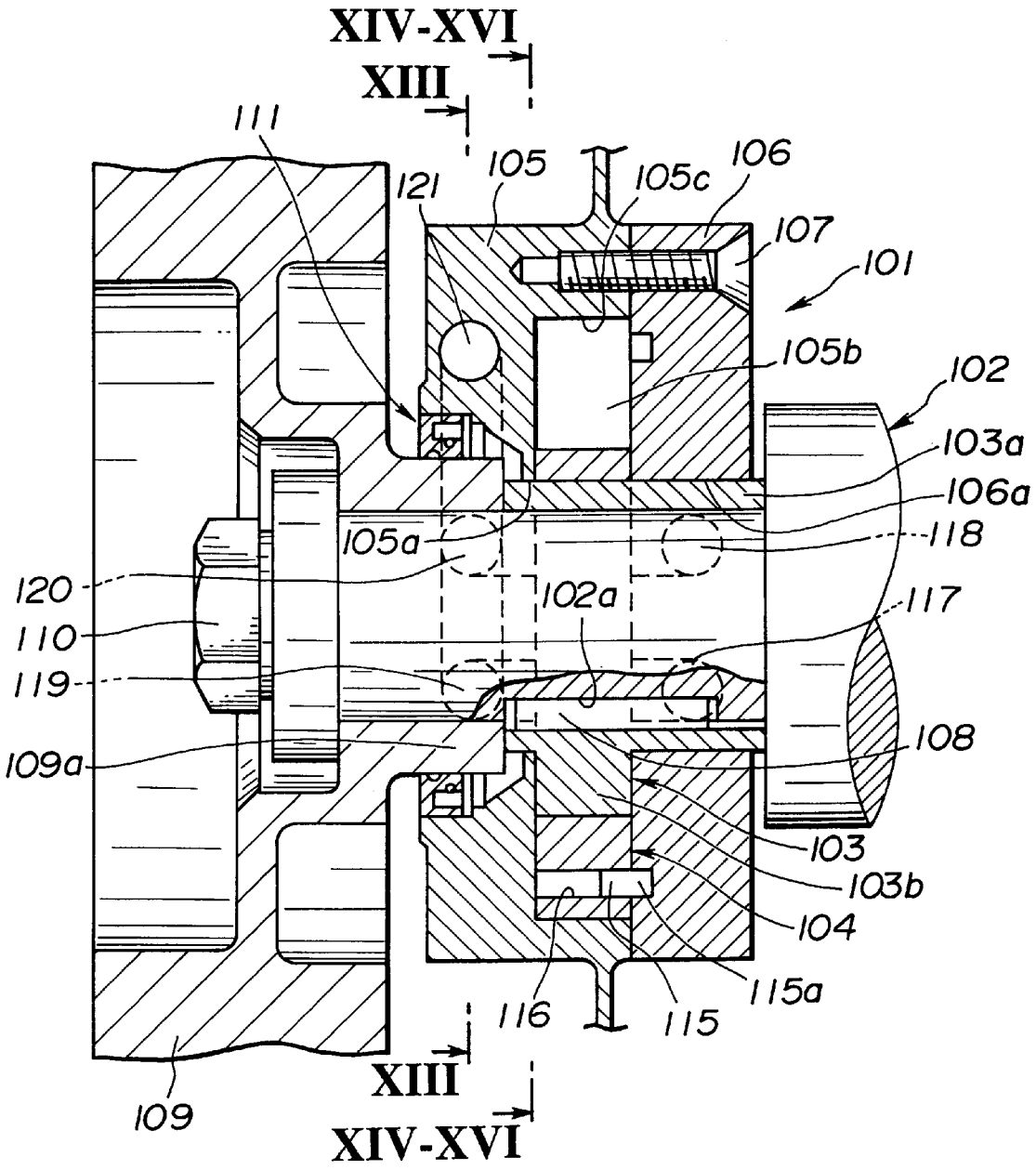
FIG. 12 is a view similar to FIG. 10, showing a third preferred embodiment of the present invention.
Figure 13:
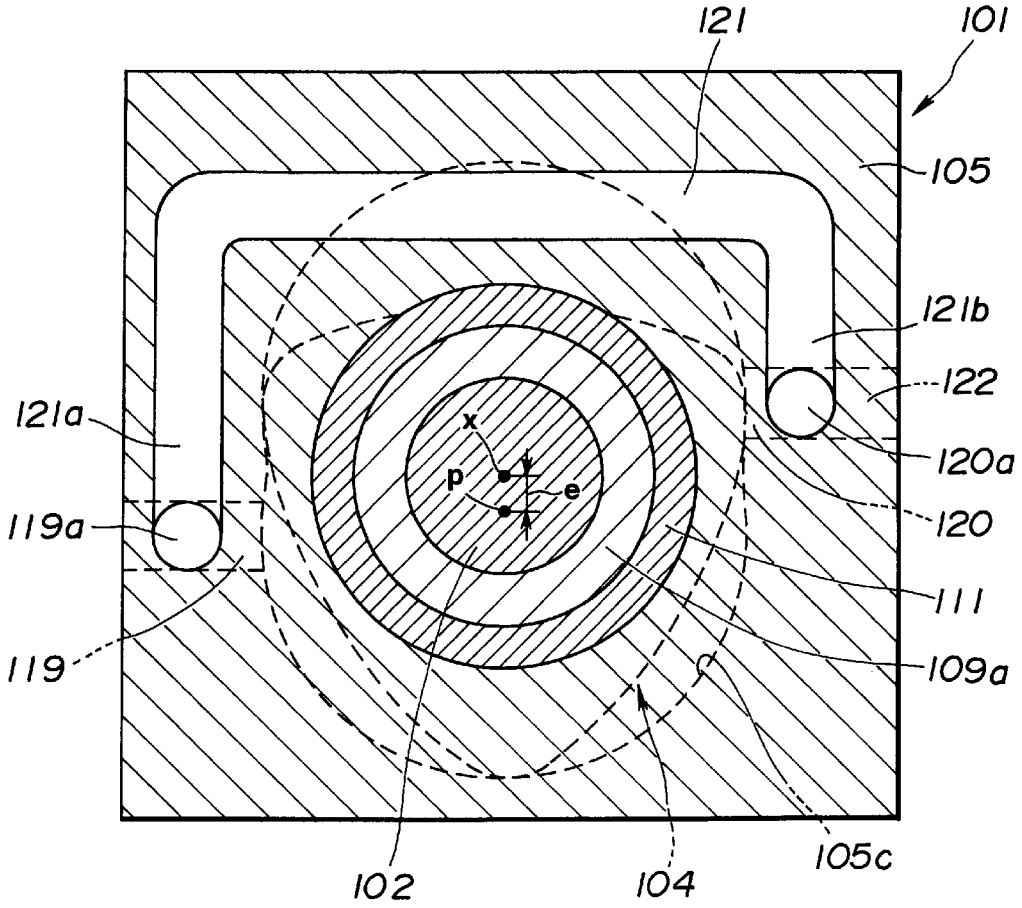
FIG. 13 is a view similar to FIG. 11, taken along the line XIII—XIII in FIG. 12.
Figure 14:
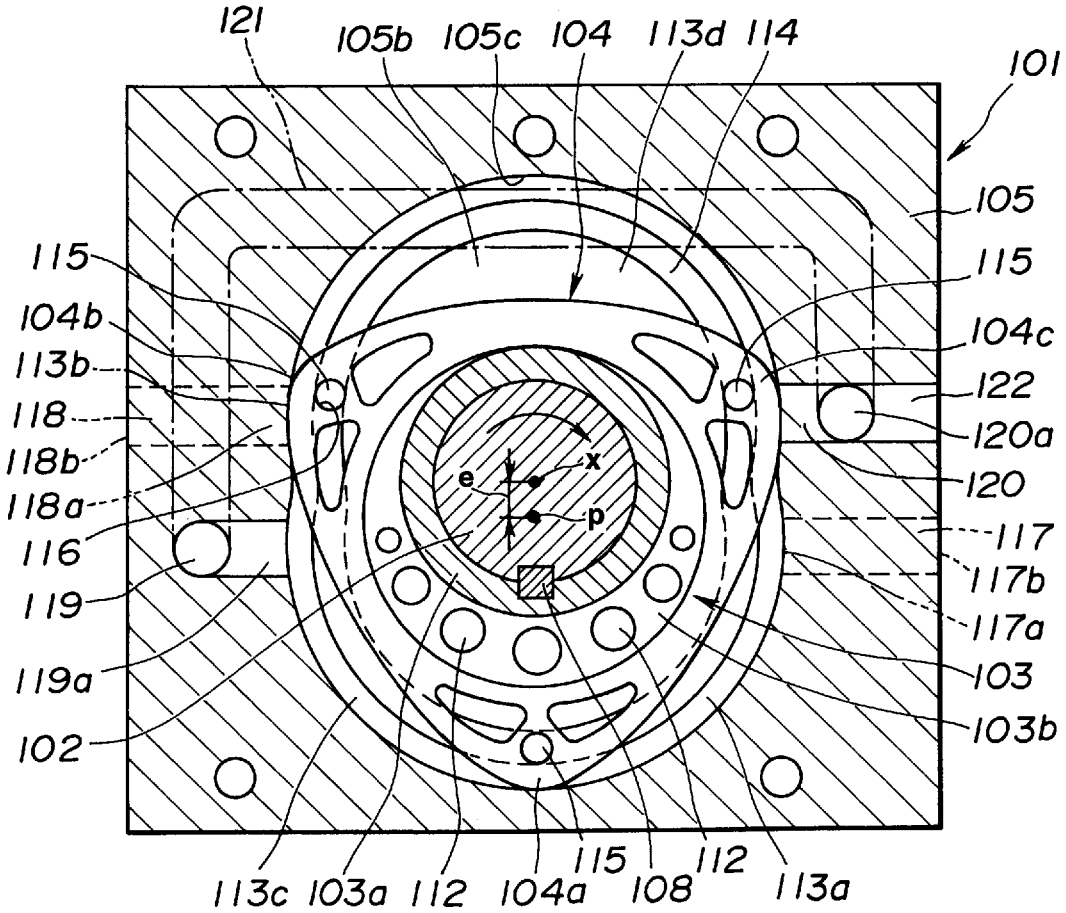
FIG. 14 is a view similar to FIG. 13, taken along the line XIV—XIV in FIG. 12.

FIGS. 12–16 show a third embodiment of the present invention. Referring to FIGS. 12–14, a rotary pump comprises a housing 101, a drive shaft 102 arranged through the housing 101, and a rotor 104 rotatably accommodated in the housing 101 and driven by the drive shaft 102 through an eccentric collar 103.

The housing 101 comprises a housing main body 105, and a cover 106 fixed to the housing main body 105 at one end thereof by a flush bolt 107 so as to close an opening thereat. The housing main body 105 has a substantially rectangular form, and is formed with a through hole 105*a* in the center thereof. The housing body 105 has on one end face a cocoon-like concavity 105*b* having the inner periphery formed in a trochoid curved surface 105*c*. Moreover, the cover 106 has a rectangular form like the housing main body 105, and is positioned thereto by a positioning pin, not shown, upon assembling.

The drive shaft 102 is directly connected to a crankshaft of the internal combustion engine. The drive shaft 102 has the outer periphery on which an eccentric collar 103 is fixed by a key 108 arranged in an outer-periphery groove 102*a* formed longitudinally, and an end to which a drive pulley 109 is fixed by a bolt 110 axially engaged therewith. The drive pulley 109 has on the inner-periphery side of the main body thereof a cylindrical portion 109*a* engaged with the outer periphery of the drive shaft 102, and serves to transmit torque to the drive shaft 102 through a timing belt, not shown. A sealing member 111 is interposed between the inner periphery of the housing 101 and the cylindrical portion 109*a* of the drive pulley 109.

As shown in FIG. 14, the eccentric collar 103 comprises a cylindrical portion 103*a* engaged with the outer periphery of the drive shaft 102, and an eccentric plate 103*b* integrally formed with the cylindrical portion 103*a* on the drive-pulley side outer periphery thereof. The eccentric collar 103 has a center P which is radially eccentric to an axis X of the drive shaft 102 by e. The cylindrical portion 103*a* has front and rear ends extending up to a through hole 105*a* of the housing main body 105 and a through hole 106*a* of the cover 106. For axial positioning, the front end abutting on an edge of the cylindrical portion 109*a* of the drive pulley 109, and the rear end abutting on a stepped end face of the drive shaft 102. The eccentric plate 103*b* is circumferentially formed with holes 112 of different sizes for weight reduction and balance.

The rotor 103 has the thickness or width which is slightly smaller than the width of the concavity 105*b* of the housing main body 105, and has the outer surface between vertexes 104*a*–104*c* which cooperates with the trochoid curved surface 105*c* of the housing main body 105 to define four working chambers 113*a*–113*d*. The rotor 104 makes rotation with the vertexes 104*a*–104*c* always contacting the trochoid curved surface 105*c* to trace a peritrochoid curve. As shown in FIG. 12, a circular hole is formed in the center of the rotor 104, and has an inner periphery 104*d* engaged with an outer periphery 103*c* of the eccentric plate 103*b* of the eccentric collar 103.

Figure 15:
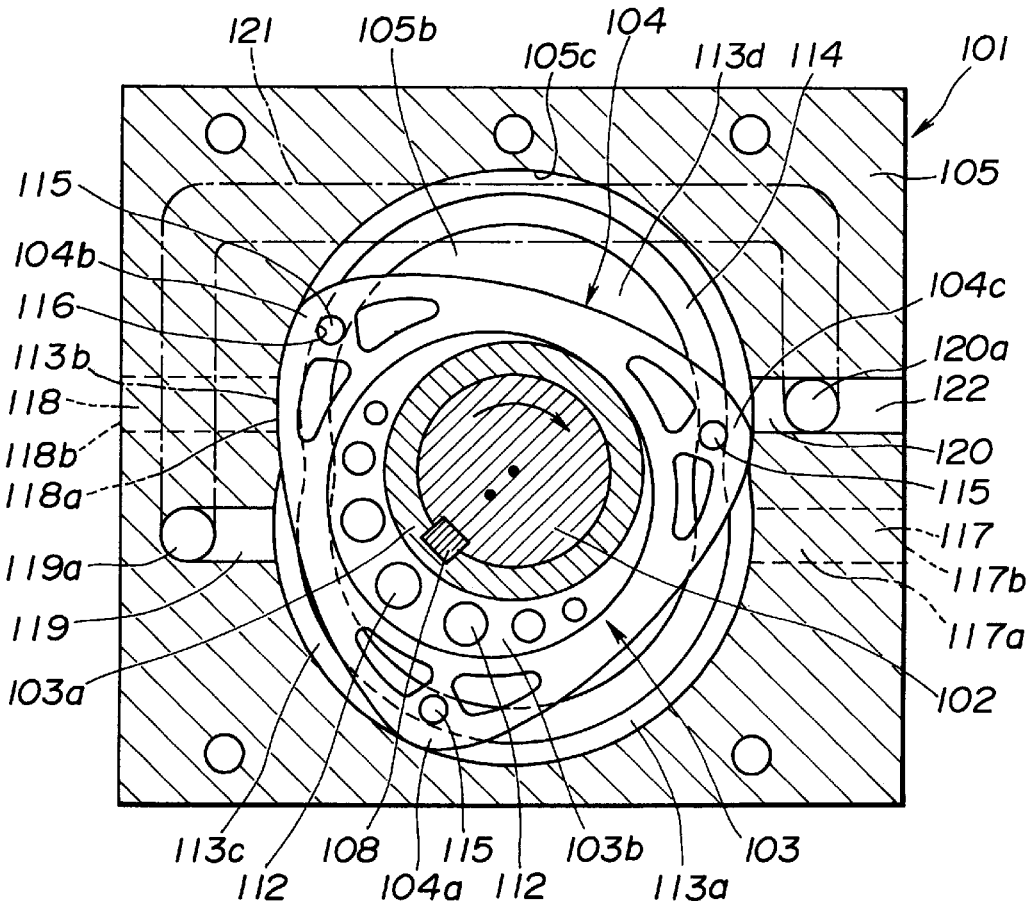
FIG. 15 is a view similar to FIG. 14, taken along the line XV—XV in FIG. 12.
Figure 16:
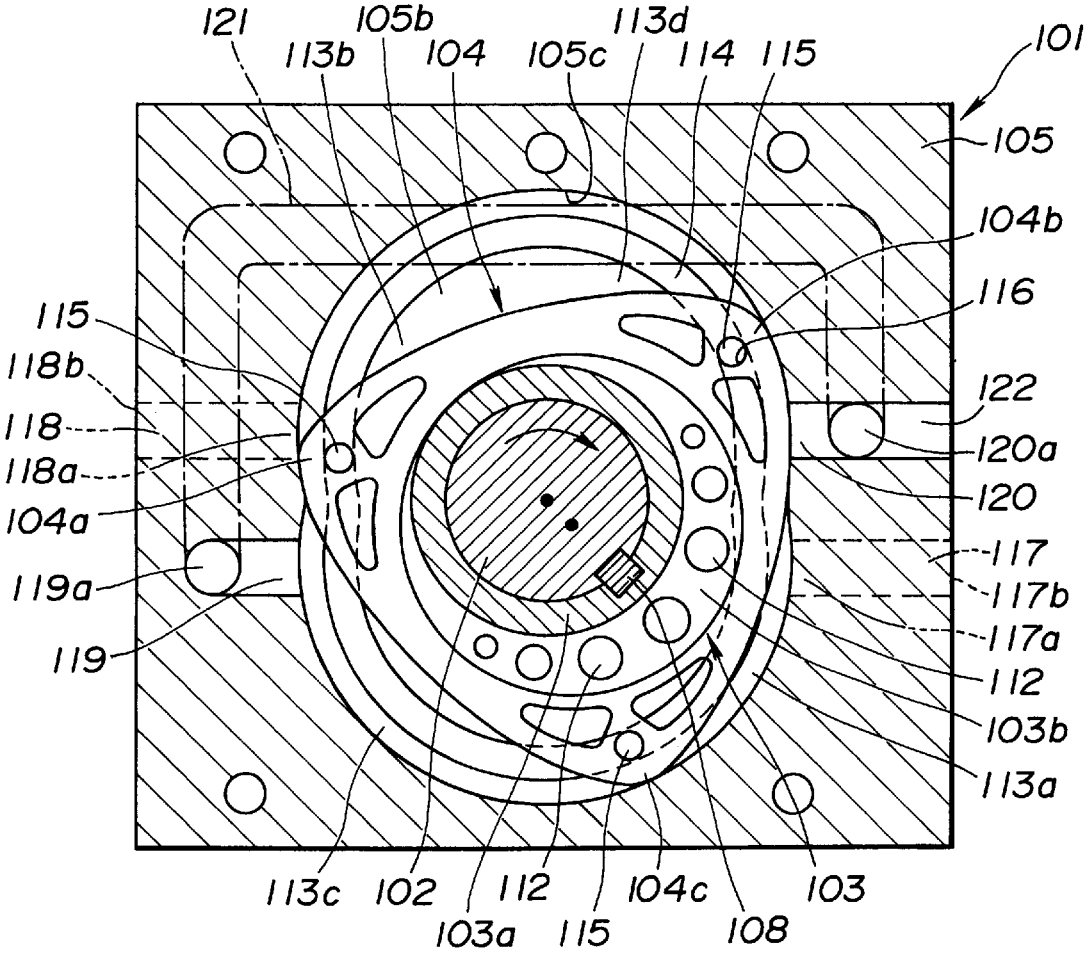
FIG. 16 is a view similar to FIG. 15, taken along the line XVI—XVI in FIG. 12.

Referring to FIGS. 14–16, the four working chambers, which are defined in accordance with the rotational positions of the rotor 104, include a first suction working chamber 113*a*, a second suction working chamber 113*b* simultaneously defined on the opposite side thereof, a first discharge working chamber 113*c*, and a second discharge working chamber 113*d* defined on the opposite side thereof, the discharge working chambers being converted from the suction working chambers after their maximum volume change.

A guide means is arranged between the cover 106 and the rotor 104 to rotatably guide the rotor 104 along the trochoid curved surface 105*c*. Specifically, the guide means comprises an endless guide groove 114 formed on an inner side-surface 106*b* of the cover 106, and three guide pins 115 arranged to a side surface of the rotor 104 on the side of the inner side-surface 106*b* and engaged with the guide groove 114.

As shown in FIGS. 12 and 14, the guide groove 114 is formed on the inner side-surface 106*b* to have a C-shaped cross section, and is shaped like a cocoon along the trochoid curved surface 105*c*. On the other hand, each guide pin 115 has a base press fit in a fixing hole 116 arranged through the rotor 104 in the vicinity of each vertex 104*a*–104*c* to correspond to the guide groove 114, and a pointed end 115*a* engaged with the guide groove 114 with a slight clearance.

Referring to FIGS. 14–16, the cover 106 has a pair of suction ports 117, 118 formed therein. The suction ports 117, 118 are oppositely formed substantially horizontally with respect to both side portions of the cover 106, and with slight vertical offset with respect thereto. The first suction port 117 has an end 117*a* which can communicate with the first suction working chamber 113*a* defined with rotation of the rotor 104, whereas the second suction port 118 has an end 118*a* which can communicate with the second suction working chamber 113*b*. Inlets 117*b*, 118*b* of the suction ports 117, 118 communicate with an oil pan through a confluent passage, not shown, into which two passages connected to the inlets 117*b*, 118*b* merge upstream.

Referring to FIGS. 12–16, the housing main body 105*a* has a pair of discharge ports 119, 120 formed therein. The discharge ports 119, 120 are oppositely formed substantially horizontally with respect to both side portions of the housing main body 105*a* and in parallel to the suction ports 117, 118, and with slight vertical offset with respect thereto. The first discharge port 119 arranged below the second suction port 118 has an end which can communicate with the first discharge working chamber 113*c* defined with rotation of the rotor 104, whereas the second discharge port 120 arranged above the first suction port 117 has an end which can communicate with the second discharge working chamber 113*d*.

As shown in FIG. 13, outlets 119*a*, 120*a* of the discharge ports 119, 120 are connected to each other through a communication passage 121, a downstream end of which is connected to a confluent passage 122. Specifically, the communication passage 121 is formed in the housing main body 105 to have a substantially C-shape, having one end 121*a* connected to the outlet 119*a* of the first discharge port 119, and another end 121*b* connected to the outlet 120*a* of the second discharge port 120. On the other hand, the confluent passage 121 is formed by extending the second discharge port 120, having an upstream end or a confluent point to which the another end 121*b* of the communication passage 121 and the outlet 120*a* of the second discharge port 120 are connected. The confluent passage 122 has a downstream end connected to a main oil passage of the engine through a passage, not shown.

Thus, according to the third embodiment, when the drive shaft 102 is rotated through the drive pulley 109, the eccentric collar 103 is also rotated synchronistically to transmit torque through the outer periphery to the rotor 104. Referring to FIGS. 14–16, this makes rotation of the rotor 104 along the trochoid curved surface 105*c* with the guide pins 115 being slidingly moved and smoothly guided in the guide groove 114.

A consideration will be made with regard to the operation of the pump in the rotational positions of the rotor 104 as shown in FIGS. 14–16. In the position as shown in FIG. 14, the vertex 104*b* of the rotor 104 closes the end 118*a* of the second suction port 118, whereas the vertex 104*c* of the rotor 104 is about to open an end of the second discharge port 120. That is, the suction stroke of lubricating oil is completed from the second suction port 118 to the second suction working chamber 113*b*, and the second suction working chamber 113*b* is converted to the second discharge working chamber 113*d* to start to discharge lubricating oil from the second discharge working chamber 113*d* to the second discharge port 120 (from the expansion stroke to the compression stroke). Simultaneously, suction of lubricating oil is started from the first suction port 117 to the first suction working chamber 113*a*.

At this stage, lubricating oil within the first discharge working chamber 113*c* is discharged to the first discharge port 119 to flow, via the communication passage 121 and the confluent passage 122, into the main oil passage.

When the rotor 104 rotates further to take the position as shown in FIG. 15, the volume of the first suction working chamber 113*a* is gradually increased to continuously quickly suck lubricating oil from the first suction port 117 to the first suction working chamber 113*a*, and start to suck lubricating oil from the second suction port 118 to the second suction working chamber 113*b*. At this stage, lubricating oil is continuously discharged from the first discharge working chamber 113*c* to the first discharge port 119, and lubricating oil within the second discharge working chamber 113*d* is immediately discharged to the second discharge port 120 by rotation of the rotor 104 (discharge stroke). Thus, lubricating oils simultaneously discharged from the discharge ports 119, 120 flow into the confluent passage 122 via the communication passage 121 with respect to the first discharge port 119, and directly with respect to the second discharge port 120.

When the rotor 104 rotates further to take the position as shown in FIG. 16, lubricating oil is continuously sucked from the second suction port 118 to the second suction working chamber 113*b*, and it is also sucked from the first suction port 117 to the first suction working chamber 113*a*. Simultaneously, the vertex 104*b* of the rotor 104 gradually closes the second discharge port 120, so that the discharge stroke comes to an end to proceed to the compression stroke. However, due to communication of the first discharge port 119 with the first discharge working chamber 113*c*, lubricating oil discharged to the first discharge port 119 flows into the confluent passage 122 via the communication passage 121.

When the rotor 104 rotates further to take the position as shown in FIG. 14, the compression stroke starts in the second discharge working chamber 13*d*, and simultaneously, the second discharge port 120 is opened to immediately proceed to the discharge stroke.

In brief, with rotation of the rotor 104, the suction, expansion, compression, and discharge strokes are repeatedly carried out, ensuring the pump operation. As soon as the expansion stroke proceeds to the compression stroke, the discharge working chambers 113*c*, 113*d* communicate with the discharge port 119, 120 to discharge lubricating oil within the discharge working chambers 113*c*, 113*d* to the discharge ports 119, 120 without carrying out strong compression of lubricating oil or non-compressible fluid, enabling the continuous pump operation.

In such a way, the third embodiment makes slight modifications in the fundamental structure of the rotary engine to materialize a rotary pump, enabling increased discharge amount per rotation of the rotor 104 due to increased volume of the working chambers 113*a*–113*d*, resulting in an improvement of the pump efficiency. That is, the rotary pump has greater maximum volume of the working chambers 113*a*–113*d* than that of the other oil pump such as an internal gear pump, having increased discharge amount per rotation of the rotor 104. This enables a rotary pump with fully-reduced overall size when having the same capacity as that of the conventional oil pump, contributing to a reduction in pump size and weight.

Further, pairs of suction working chambers 113*a*, 113*b*, suction working chambers 113*c*, 113*d*, suction ports 117, 118, and discharge ports 119, 120 enable simultaneous double pump operation, obtaining a further improvement of the pump efficiency, resulting in a further reduction in pump size and weight.

Furthermore, in the third embodiment, lubricating oils simultaneously discharged from the discharge ports 119, 120 flow into the confluent passage 122 in interfering with each other, restraining discharge surging. This results in quick flowing of smoothed lubricating oil into the main oil passage.

Still further, in addition to the discharge ports 119, 120, the communication passage 121 and the confluent passage 122 are formed in the housing main body 105, resulting in simpler and smaller piping structure than that with the communication passage, etc. arranged outside the housing main body 15.

Still further, in the third embodiment, the guide means includes the guide groove 114 and the guide pin 115 in place of a gear, obtaining largely simplified structure and reduced number of parts, resulting in an improvement of the manufacturing efficiency and a cost reduction. The simplified structure exempts requirements of the high machining accuracy of the guide groove 114, etc., contributing to an improvement of the machining efficiency.

Further, due to the fact that the guide groove 114 is formed in the cover 106 by notching, and the guide pin 115 is simply fixed to the rotor 104, a space for mounting the gear is not needed, resulting in a reduction in pump size and weight.

Figure 17:
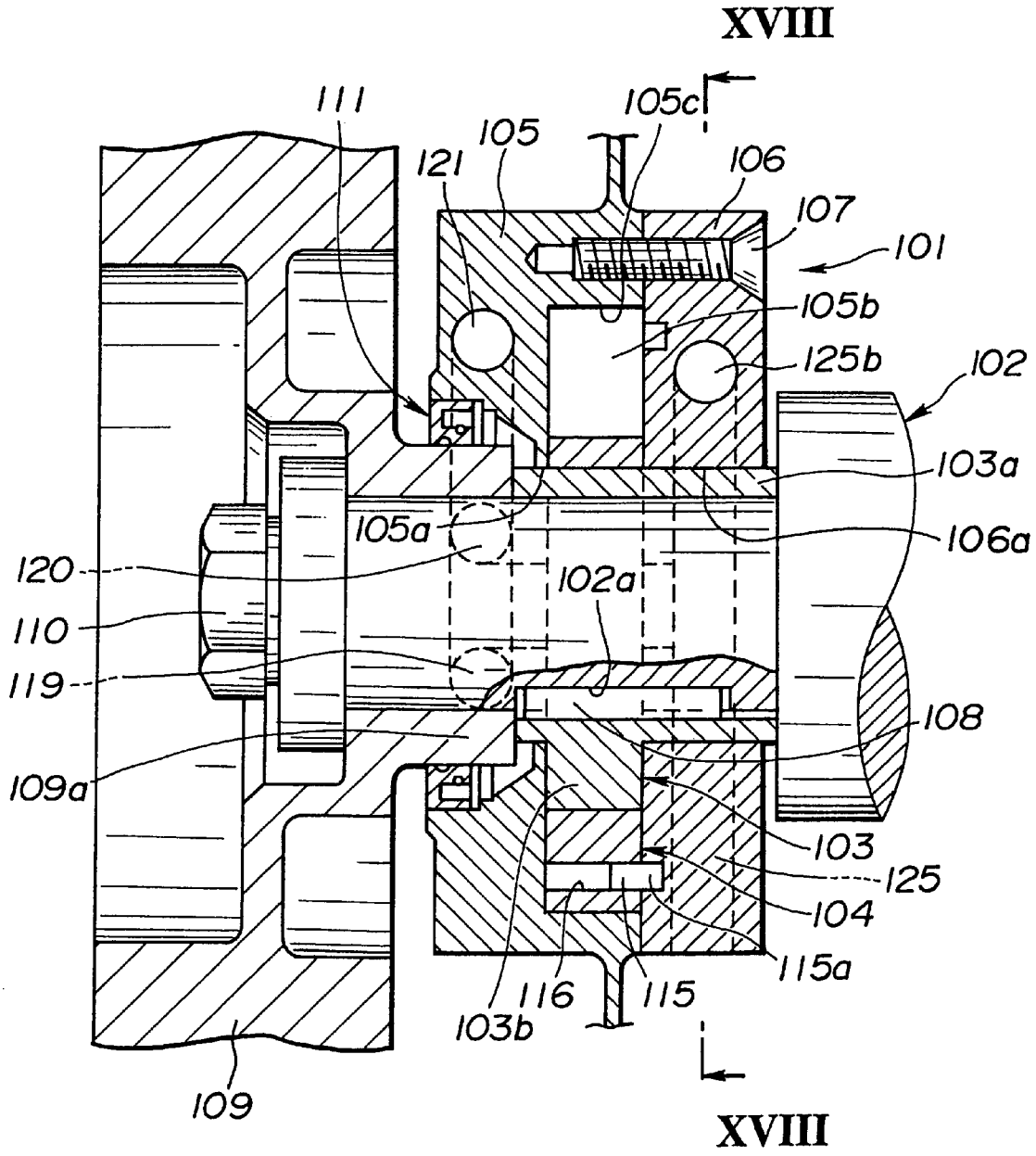
FIG. 17 is a view similar to FIG. 12, showing a fourth embodiment of the present invention.
Figure 18:
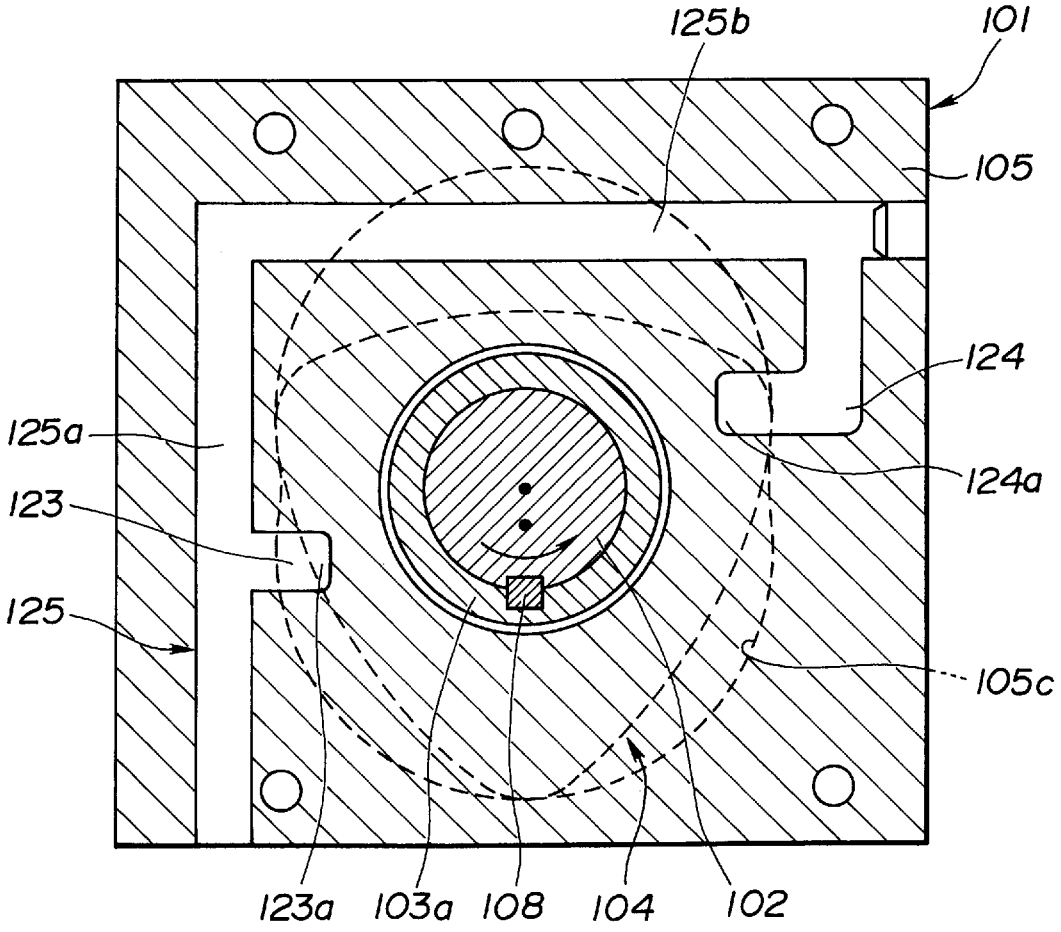
FIG. 18 is a view similar to FIG. 16, taken along the line XVIII—XVIII in FIG. 17.

FIGS. 17 and 18 show a fourth embodiment of the present invention wherein a pair of suction branch ports 123, 124 are branched from a substantially L-shaped main port 125. Specifically, the main port 125 includes an upstream portion 125*a* vertically formed in one side portion of the cover 106, and a downstream portion 125*b* extending horizontally from the upper end of the upstream portion 125*a*, the upstream portion 125*a* having an upstream end which communicates with the oil pan through a suction passage, not shown. The first suction port 123 extends horizontally from substantially the center of the upstream portion 125*a*, and has an end 123*a* communicating with the first suction working chamber 113*a*. The second suction port 124 extends downward from a downstream end of the downstream portion 125*b* to form substantially an L-shape, and has an end 124*a* which communicates with the second suction working chamber 113*b*.

Thus, the fourth embodiment not only produces the same effect as that of the third embodiment, but achieves, with the suction ports 123, 124 branched in the cover 106 from the main port 125, the simpler passage structure than that of the first embodiment where the suction ports communicate with each other through a passage outside the cover 2, resulting in an improvement of the manufacturing efficiency and a cost reduction.

It is noted that the rotary pump according to the present invention can operate not only with oil, but the other non-compressible fluids such as water.

Further, it is noted that, in place of being directly connected to the crankshaft of the internal combustion engine, the drive shaft 4, 102 may be constructed to receive torque through a timing belt, etc.

Still further, it is noted that the communication passage 121 and confluent passage 122, and the discharge ports 119, 120 can be arranged in the cover 106, whereas the suction ports 117, 123 can be arranged in the housing main body 105.

What is claimed is:

1. A pump operable in suction and compression strokes, comprising:

a housing with an inner periphery, said inner periphery including a trochoid curved surface;

a rotor rotatably arranged in said housing, said rotor having a substantially triangular shape, said rotor including vertexes slideably contacting said trochoid curved surface of said housing, said housing and said rotor cooperating with each other to define suction working chambers and discharge working chambers;

suction ports that respectively communicate with said suction working chambers when the pump proceeds to the suction stroke;

first passages that respectively communicate with said suction ports, said first passages and said suction ports being always in fluid communication, said first passages being formed through said housing;

a second passage that communicates with said first passages, said second passage being formed through said housing and being always in fluid communication with said first passages; and discharge ports that respectively communicate with said discharge working chambers when the pump proceeds to the compression stroke.

2. A pump as claimed in claim 1, wherein said discharge ports are formed through said housing.

3. A pump as claimed in claim 2, wherein said discharge ports have outlets disposed in different positions.

4. A pump operable in suction and compression strokes, comprising:

a housing with an inner periphery, the inner periphery including a trochoid curved surface;

a rotor rotatably arranged in the housing, the rotor having a substantially triangular shape, the rotor including vertexes slideably contacting the trochoid curved surface of the housing, the housing and the rotor cooperating with each other to define suction working chambers and discharge working chambers;

suction ports that respectively communicate with the suction working chambers when the pump proceeds to the suction stroke;

discharge ports that respectively communicate with the discharge working chambers when the pump proceeds to the compression stroke;

a communication passage communicating with respective outlets of the discharge ports, said communication passage and said discharge ports being always in fluid communication, said fluid communication passage being formed through said housing; and a confluent passage connected to the communication passage on the downstream end thereof, said confluent passage being formed through said housing and always being in fluid communication with said communication passage.

5. A pump according to claim 4, wherein the suction ports comprises a first suction port and a second suction port, and the discharge ports comprises a first discharge port and a second discharge port.

6. A pump according to claim 5, wherein the first and second discharge ports extend substantially horizontally from the respective discharge chambers in the opposite directions.

7. A pump according to claim 6, wherein the first and second suction ports extend substantially horizontally from the respective suction chambers in the opposite directions.

8. A pump according to claim 7, wherein the first and second suction ports are substantially parallel to the first and second discharge ports.

9. A pump according to claim 8, wherein the first and second suction ports are offset vertically relative to each other.

10. A pump according to claim 9, wherein the first and second discharge ports are offset vertically relative to each other.

11. A pump according to claim 10, wherein the first discharge port is positioned below the second suction port and the second discharge port is positioned above the first suction port.

12. A pump according to claim 5, wherein the communication passage is substantially C shaped, one end of which is connected to an outlet of the first discharge port and another end of which is connected to an outlet of the second discharge port.

13. A pump according to claim 12, wherein the confluent passage extends from the second discharge port, wherein the outlet of the second discharge port is connected to an upstream end of the confluent passage and the another end of the communication passage.

* * * * *